US007240640B2

(12) United States Patent
Kinnunen

(10) Patent No.: US 7,240,640 B2
(45) Date of Patent: Jul. 10, 2007

(54) TOWER BOILER INCLUDING A STATIONARY SUPPORTING STRUCTURE

(75) Inventor: Pertti Kinnunen, Varkaus (FI)

(73) Assignee: Foster Wheeler Energia Oy, Helsinki (FI)

( * ) Notice: Subject to any disclaimer, the term of this patent is extended or adjusted under 35 U.S.C. 154(b) by 0 days.

(21) Appl. No.: 10/536,448

(22) PCT Filed: Nov. 26, 2003

(86) PCT No.: PCT/FI03/00900

§ 371 (c)(1),
(2), (4) Date: Oct. 3, 2005

(87) PCT Pub. No.: WO2004/048849

PCT Pub. Date: Jun. 10, 2004

(65) Prior Publication Data

US 2006/0185624 A1 Aug. 24, 2006

(30) Foreign Application Priority Data

Nov. 26, 2002 (FI) ..... 20022099

(51) Int. Cl.
*F22B 37/24* (2006.01)

(52) U.S. Cl. ..... 122/450; 122/493; 122/510

(58) Field of Classification Search ..... 122/493, 122/510, 511, 4 D, 494, 496, 450
See application file for complete search history.

(56) References Cited

U.S. PATENT DOCUMENTS

| | | | | |
|---|---|---|---|---|
| 3,396,707 | A * | 8/1968 | Bagley et al. | 122/510 |
| 4,286,549 | A * | 9/1981 | Eisinger | 122/510 |
| 4,510,892 | A | 4/1985 | Wincze et al. | 122/510 |
| 5,143,024 | A * | 9/1992 | Yokoyama et al. | 122/510 |
| 5,950,574 | A | 9/1999 | Matsuda et al. | 122/460 |
| 6,039,008 | A * | 3/2000 | Anderson et al. | 122/510 |
| 6,305,330 | B1 * | 10/2001 | Darling | 122/4 D |
| 6,651,596 | B1 * | 11/2003 | Wittchow | 122/467 |

FOREIGN PATENT DOCUMENTS

| | | |
|---|---|---|
| CN | 1122777 | 10/2003 |
| EP | 0 077 080 A2 | 4/1983 |
| EP | 0 800 037 A2 | 10/1997 |
| JP | 6-323503 | 11/1994 |
| JP | 2001-193902 | 7/2001 |

OTHER PUBLICATIONS

Russian Office Action dated May 19, 2006, issued in corresponding Russian patent application No. 2005119984, with English translation.

(Continued)

*Primary Examiner*—Gregory Wilson
(74) *Attorney, Agent, or Firm*—Fitzpatrick, Cella, Harper & Scinto

(57) ABSTRACT

A boiler plant, including a combustion section, a heat exchange section including heat exchange surfaces, arranged above the combustion section and having a flow direction from the bottom upwards, and a stationary supporting structure. The combustion section and the heat exchange section are separate chambers, flexibly joined with each other, and the chambers are each separately hung from their upper part to the stationary supporting structure.

9 Claims, 2 Drawing Sheets

OTHER PUBLICATIONS

International Search Report dated Mar. 15, 2004, mailed on Apr. 21, 2004, in corresponding PCT patent application No. PCT/FI03/00900.

Chinese Office Action dated Nov. 17, issued in corresponding Chinese patent application No. 2003-80104148, and English translation.

* cited by examiner

TOWER BOILER INCLUDING A STATIONARY SUPPORTING STRUCTURE

FIELD OF THE INVENTION

The present invention relates to a boiler plant. Thus, the invention relates to a boiler plant, comprising a combustion section, a heat exchange section located above the combustion section and including heat exchange surfaces, the heat exchange section having a flow direction of flue gas from the bottom upwards, and a stationary supporting structure.

BACKGROUND OF THE INVENTION

The heat exchange surfaces in the heat exchange section of the boiler plant generally comprise at least superheater tubes of different superheating stages and an economizer. The temperature of water or steam is gradually raised in these different heat exchange surfaces. In order to achieve an end temperature, which is as high as possible, different heat exchange surfaces are most advantageously arranged to a heat exchange section in an order according to their desired end temperatures in such a way that hot flue gas entering from the combustion section encounters first the heat exchange surface which has the highest end temperature.

The heat exchange surfaces are usually packages of mainly horizontal, several times back and forth, bent tubes. Generally, the diameters of the tubes and the distances between the tubes diminish when moving towards lower temperatures. For example, the distances between the economizer tubes from each other are usually shorter than the distances between the tubes of the superheater packages, in order to achieve a sufficient heat exchange efficiency.

Ashes and other particles which can stick on the heat exchange surfaces are entrained with the flue gases exiting the combustion chamber. The thus generating deposits diminish the heat exchange coefficient, and thus, also diminish the heat exchange efficiency. Thick deposits may also disturb the flow of the gas between the heat exchange tubes, which further diminish the heat exchange efficiency.

When the ash deposit layer becomes too thick, it may fall off by itself from the surface of the heat exchange tubes, or it may be dislodged by some appropriate sootblowing method. The dislodged ash drops back to the combustion section or to the bottom of the heat exchange section, where it may be guided, for example, to the ash discharge system of the plant.

In order to avoid the sticking of falling ashes on the lower heat exchange surfaces, a so-called tower boiler construction is preferably used, especially when combusting fuels with difficult ashes, such as brown coal. The heat exchange section in the tower boiler is arranged above the combustion section in such a way that the flow direction of the flue gas is in the heat exchange section from the bottom upwards. Thus, the ashes that fall off or are dislodged from the upper heat exchange surfaces of the heat exchange section fall towards the sparse tube packages lower, and the risk of falling ashes sticking on the lower packages is rather small.

Large boiler constructions are usually built to be top-supported in such a way that a stationary supporting construction is set up around the boiler, and the boiler is assembled to hang on strong suspension wires from a supporting plane at the upper part of the support construction. Problems with a tower boiler built as indicated above relate to the fact that the height of a one-piece construction becomes very high. In fact, the height of a tower boiler in a large power plant may be more than 100 m.

When the boiler is started up, the temperature of the boiler body rises by hundreds of degrees. The upper part of the boiler hung from above remains stationary, but the lower part thereof lowers down tens of centimeters. Such a great thermal motion sets very high flexibility requirements for the connections to be made to the lower part of the boiler tower. For example, the inlet systems for fuel and the outlet systems for bottom ash must be able to allow such a motion between the stationary parts of the system and the parts connected to the boiler.

The assembly of the boiler usually takes place gradually in such a way that the upmost parts are connected to the stationary supporting structure first. Only after the assembly of the upper parts, is it possible to connect the lower parts connecting thereto. Since a tower boiler is usually a very high, one-piece structure, the assembly thereof is very time-consuming. This slows down the construction of the boiler plant and increases the construction costs.

SUMMARY OF THE INVENTION

An object of the present invention is to provide a boiler, in which the above-mentioned drawbacks of the prior art are minimized or eliminated.

In particular, an object of the present invention is to provide a tower boiler, in which the thermal motion of the lower part of the boiler is minimized.

Additionally, an object of the present invention is to provide a tower boiler, the assembly of which could be performed in a shorter time than the assembly of the present tower boilers.

In order to solve the above-mentioned problems of the prior art, a boiler is provided, the characterizing features of which are defined in the claims. Thus, a characterizing feature of a boiler plant in accordance with the present invention is that the combustion section and the heat exchange section thereof are separate chambers, flexibly joined with each other, and each chamber is separately hung from its upper part to the stationary supporting structure.

The present invention especially relates to a so-called tower boiler, in the heat exchange section of which the main flow direction of the flue gas is from the bottom upwards. Generally, the heights of the combustion section and the heat exchange section are both about half of the total height of the boiler. Since the combustion section of the boiler in accordance with the present invention is hung from its upper part to a stationary supporting structure, the thermal motions significant in the lower part thereof are only about half of the thermal motions in the lower part of a corresponding one-piece tower boiler. This considerably decreases problems, which the thermal motions cause with different connections made between the lower part of the combustion section and its stationary surroundings. Thus, for example, the inlet systems for fuel and the outlet systems for bottom ash are simplified. At the same time, the costs thereof decrease and the operating reliability improves.

A boiler in accordance with the present invention comprises a channel between the upper part of the combustion section and the lower part of the heat exchange section. Hot flue gases are guided along the channel from the combustion section to the heat exchange section. Since the combustion section in the arrangement in accordance with the present invention is hung from the top to a stationary supporting structure, the upper part of the combustion section remains stationary. Since the heat exchange section on the other hand is hung to a stationary supporting structure from its upper part, the lower part thereof moves due to the thermal expansion. Therefore, the channel connecting the upper part of the combustion section and the lower part of the heat exchange section must be flexible.

Since the height of the heat exchange section is typically about half of the total height of the boiler, the thermal motion between the lower part of the heat exchange section and the upper part of the combustion section is relatively small. There are no great solid flows which would require heavy structures, running between the combustion section and the heat exchange section of the tower boiler. Therefore, the channel may be made flexible relatively simply, for example, by means of bellows of sufficiently flexible bend elements.

Conventional tower boilers are usually suspension-fired boilers, in which pulverized fuel, e.g., coal, is supplied through burners to the furnace, where it quickly burns at a high temperature. The cooled combustion section of a one-piece tower boiler must be so high that the flue gases have time to cool down sufficiently before they hit the first heat exchange surfaces. There is a requirement that the ash entrained with the flue gases does not contain melted or partly melted particles that could solidify on the heat exchange surfaces.

The channel between the combustion section and the heat exchange section of a pulverized coal fired boiler may be, according to a preferred embodiment of the present invention, cooled. The flue gas thereby cools down also in the channel and the height of the combustion section may be less than that in a conventional tower boiler without the melted fly ash hitting the heat exchange surfaces of the heat exchange surfaces of the heat exchange section.

In a conventional tower boiler, the heat exchange section is directly above the combustion section, whereby the ash deposits dislodged from the heat exchange surfaces fall back to the combustion section. In some cases, there is no desire to return the ash deposits to the combustion section, but it would be advantageous to remove them directly from the heat exchange section. According to a preferred embodiment of the present invention, the channel for flue gas joining the combustion section to the heat exchange section or the junction point of the channel and the heat exchange section has at least one bend, to which an ash collection hopper is arranged. The ashes dislodged from the heat exchange surfaces may thus preferably be gathered to the hopper, from where they may be guided to the ash removal system of the plant.

According to another preferred embodiment of the invention, the boiler is a circulating fluidized bed boiler, the upper part of which is connected to at least one particle separator, which separates solid particles from the flue gas. The separated solid material is returned to the lower part of the combustion section, and the cleaned flue gas is guided to a heat exchange section arranged above the combustion section. According to the invention, the combustion section and the heat exchange section are chambers, separately hung from above, and the channel leading from the separator to the heat exchange section is flexible. The flue gas releases heat on the heat exchange surfaces of the heat exchange section to the water or steam flowing in the heat exchange tubes.

The upper part of the supporting structure of a conventional one-piece tower boiler has a horizontal main supporting plane, to which the whole one-piece tower boiler is assembled to hang by suspending wires. The assembly of a tower boiler proceeds from the top downwards, whereby the assembly of the different parts of the boiler mostly takes place sequentially in a certain order. Thus, the different assembly phases depend on each other, and the assembly of the boiler as a whole takes a long time, typically fifteen to twenty months.

The supporting structure of a tower boiler in accordance with the present invention preferably comprises two separate horizontal supporting planes, of which the first is assembled below the second. When the tower boiler in accordance with the present invention is assembled, the combustion section thereof may be assembled to the lower supporting plane at the same time as the heat exchange section thereof may be assembled to the lower supporting plane at the same time as the heat exchange section is assembled to the upper supporting plane. This significantly decreases the time consumed in the assembly of the tower boiler and the apparatuses to be connected therewith.

BRIEF DESCRIPTION OF THE DRAWINGS

The invention is described below by way of examples with reference to the accompanying drawings, in which.

DETAILED DESCRIPTION OF THE PREFERRED EMBODIMENTS

Figure 1:
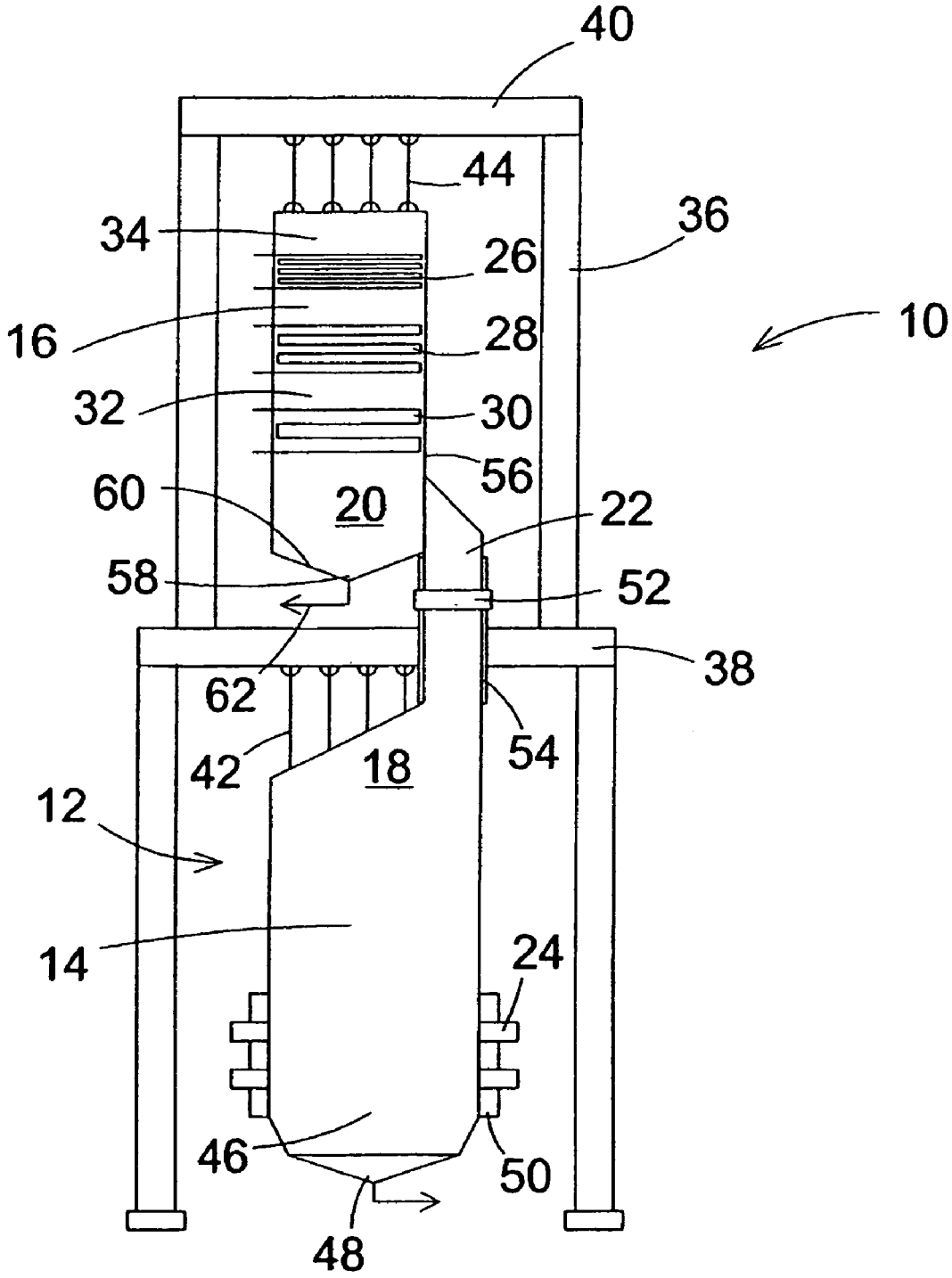
FIG. 1 schematically illustrates a boiler in accordance with a first preferred embodiment of the invention.

FIG. 1 discloses a boiler plant 10, in accordance with a first preferred embodiment, comprising a suspension-fired boiler 12. The boiler 12 is a so-called tower boiler, comprising a vertical combustion section 14 and a vertical heat exchange section 16 arranged thereabove.

The combustion section 14 and the heat exchange section 16 are separate chambers, confined by a wall, which are preferably at least partly cooled water tube walls. An upper part 18 of the combustion section 14 and a lower part 20 of the heat exchange section 16 are connected to each other by a channel 22.

When fuel, such as coal, is combusted with the burners 24 of the boiler 12, ash containing flue gas is produced. The flue gas flows from the upper part 18 of the combustion section 14 via channel 22 to the heat exchange section 16. Heat exchange surfaces of the steam generation cycle of the boiler, such as an economizer 26, a first superheater 28 and a final superheater 30, are arranged to the heat exchange section 16.

Part of the ash entrained with the flue gas accumulates on the surfaces of heat exchangers 26, 28, 30 of the heat exchange section 16. When the ash layers become too thick, ash falls off or it is dislodged from the heat exchangers, whereby the ash falls downwards in the heat exchange section 16.

The hot flue gas flowing in the heat exchange section 16 of the boiler 12 heats water or steam flowing in the tubes of the heat exchangers 26, 28, 30 whereby the flue gases cool down and the temperature of the water rises. The cooled flue gases are usually removed from the heat exchange section 16 to the cleaning apparatuses for flue gas and further through a stack to the environment, which are, however, not disclosed in FIG. 1.

The heat exchangers 26, 28, 30 are usually formed, of back and forth bent, mainly horizontal water of steam tubes. In order to get the steam superheated to a sufficient temperature, the superheaters 28, 30 are arranged in the flow direction of the flue gas to the first end 32 of the heat exchange section 16. Correspondingly, the economizer 26 is arranged in the flow direction of the flue gas to the last end 34 of the heat exchange section 16.

In order to reach a sufficient heat exchange efficiency, the diameters of the water tubes in the economizer 26 and the distances therebetween are usually smaller than in the superheaters 28, 30. If the flue gas flows downwardly in the heat exchange section, there is a risk that the ash deposits falling off from the surfaces of the surperheaters 28, 30 stick between the tubes of the economizer 26, whereby the heat exchange efficiency of the economizer may substantially decrease. The concept of the tower boiler 12 is to bring the flue gas to flow upwards in the heat exchange section 16, whereby the natural location of the economizer 26 is in the upper part 34 of the heat exchange section 16, and the above-mentioned risk is eliminated.

According to the present invention, the combustion section 14 and the heat exchange section 16 of the boiler are separate chambers, which are both separately hung to supporting structure 36 of a boiler plant in accordance with the invention preferably comprising two supporting planes 38, 40. The lower supporting plane 38 is attached above the height of the combustion section 14 and the higher supporting plane 40 is attached above the total height of the heat exchange section 16 and the combustion section 14. The combustion section, or combustion chamber, 14 is attached from its upper part to hang from wires 42 attached to the lower supporting plane 38. Respectively, the heat exchange section, or the heat exchange chamber, 16 is attached from its upper part to hang from wires 44 attached to the upper supporting plane 40.

The combustion section and the heat exchange section of a conventional tower boiler form a one-piece structure hanging by its upper part from the supporting structure of the boiler plant. Since a continuous tower boiler is often very high, the vertical thermal motions of the combustion section, caused by variations in the boiler temperature, may be significant. The combustion section 14 of a boiler in accordance with the present invention is hung directly to a supporting structure 36, which significantly reduces the vertical thermal motions of the lower part 46 of the combustion section 14 of the boiler.

The lower part 46 of the combustion section 14 includes different kinds of equipment, such as burners 24, ash removal equipment 48 and air supply equipment 50, attached to the stationary surroundings of the boiler 12. The structure of such equipment must comprise flexible elements, which bear the thermal motions of the boiler without breaking. For example, a large amount of fuel is supplied to the combustion section through burners 24, which brings high requirements for the endurance of the structure of the flexible elements. The decrease of the thermal motions in the lower part 46 of the combustion section 14 in the boiler 12, in accordance with the present invention, considerably facilitates the assembly of such equipment to be attached to the lower part of the boiler.

Since the combustion section 14 is attached from its top directly to the lower supporting plane 38, the thermal motions of the upper part 18 of the combustion section is very small. On the other hand, the heat exchange section 16 is attached from its upper part 34 to an upper supporting plane 40, wherefore the lower part 20 of the heat exchange section moves significantly when the temperature of the heat exchange section changes, for example, when the boiler is heated to the operation temperature. Thus, a channel 22 leading from the upper part 18 of the combustion section to the lower part 20 of the heat exchange section must be able to adjust according to the different thermal motion of the parts. In FIG. 1, the flexible element attached to the channel 22 is a bellows 52.

The channel 22 in the embodiment of FIG. 1 is cooled in such a way that a portion of the walls of the channel is formed of water or steam cooled tube walls 54. The tube walls 54 of the channel 22 are preferably connected to the steam generation cycle of the boiler, whereby heat is transferred from the hot flue gas discharging from the combustion section to the steam generated in the boiler. At the same time, the flue gas cools down, whereby the melted or partially melted ash particles possibly still present in the flue gas solidify and cannot thus foul the heat exchange surfaces 26, 28, 30 of the heat exchange chamber 16.

The channel 22 illustrated in FIG. 1 attaches to a side wall 56 of the heat exchange chamber 16 slightly above a lowest point 58 of the chamber. Thus, it has been possible to form a hopper 60 to the bottom of the chamber, to the bottom of which ash deposits falling from the heat exchange surfaces 26, 28, 30 accumulate. The ashes accumulated to the hopper 60 may be transferred along a channel 62 to an ash cooler, not shown in FIG. 1, and further, out from the boiler 12.

The channel 22 may alternatively be connected to the lowest point 58 of the heat exchange chamber 16. Then, the channel 22 may preferably be arranged with a bend which is connected to a hopper, where it is possible to gather ash deposits falling from the heat exchange chamber 16. The channel 22 connecting with the lowest point 58 of the heat exchange chamber may also be straight, whereby the ashes fall from the heat exchange section 16 directly back to the combustion section 14.

In some applications, it is advantageous to combine the combustion section 14 to the heat exchange section 16 by at least two channels 22, which preferably are symmetrically connected to different sides of the lower part 20 of the heat exchange section 16. Thereby, it is possible to provide a uniform flue gas flow in the heat exchange section 16 and an optimal heat exchange efficiency in different heat exchangers.

Figure 2:
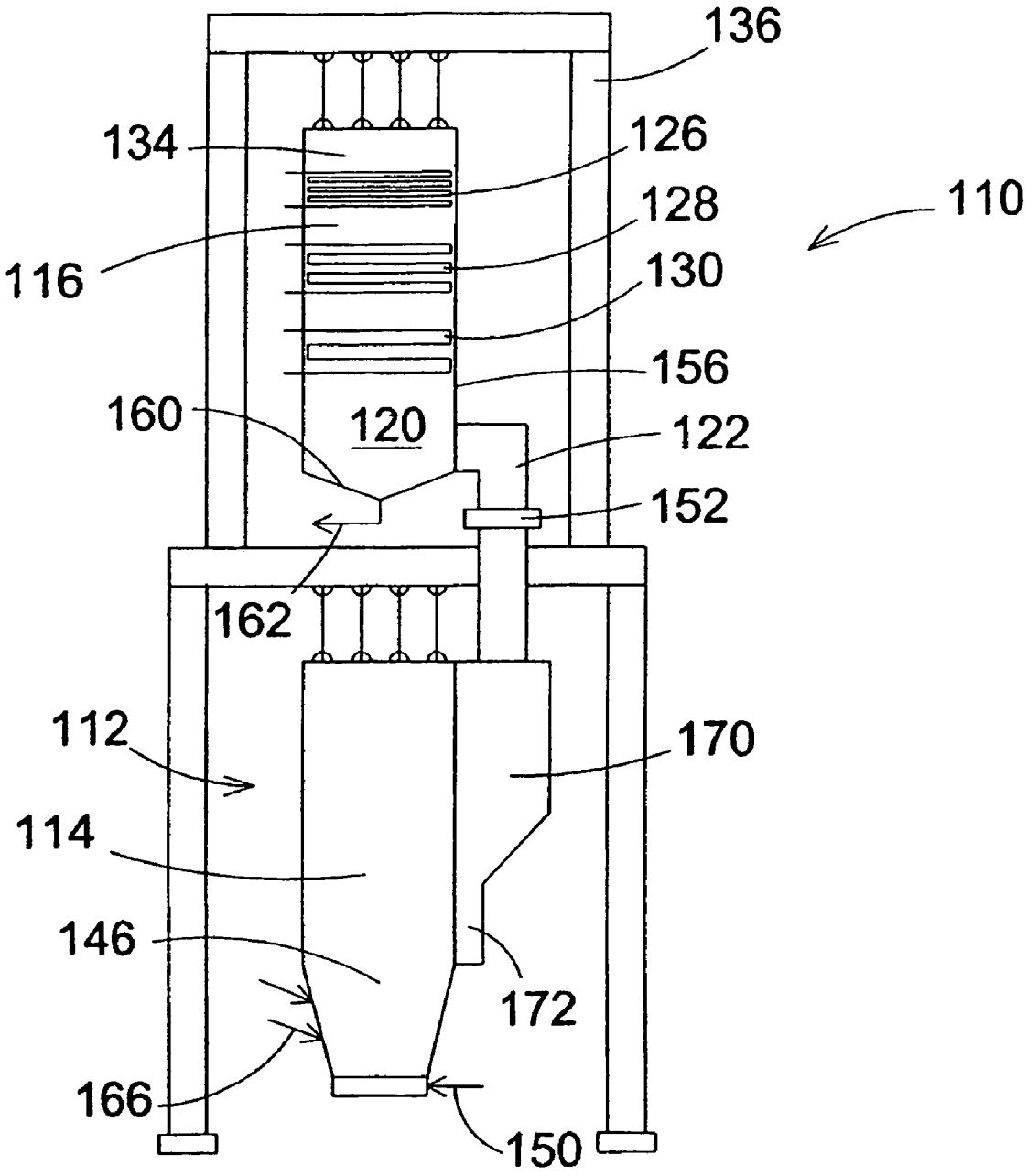
FIG. 2 schematically illustrates a boiler in accordance with a second preferred embodiment of the invention.

FIG. 2 discloses another preferred embodiment in accordance with the present invention, in which a boiler plant 110 comprises a circulating fluidized bed boiler 112. The combustion section 114 and heat exchange section 116 of the boiler are separate chambers, which both are hung from their top to a stationary supporting structure 136.

The lower part of the combustion chamber 114 of the circulating fluidized bed boiler 112 is provided with means 166 for feeding fuel and bed material, for example, sand. The bottom of the combustion section is connected with air feed equipment 150, whereby air is introduced for combusting fuel and fluidizing bed material.

The flow direction of the flue gas in the heat exchange chamber 116 is from the bottom upwards. Thereby, an economizer 126 may preferably be located to an upper part 134 of the chamber and the sticking of ash deposits, falling from the superheater pipings 128, 130 on the heat exchange tubes densely arranged to the economizer 126, is prevented.

Hot flue gas exiting from the combustion section 114 is guided to the heat exchange section 116 by a channel 122. According to the present invention, the channel 122 comprises a flexible element, for example, a bellows 152, which is able to adjust with the thermal motions of the lower portion 120 of the heat exchange section 116.

The circulating fluidized bed boiler 112 in accordance with FIG. 2 comprises a particle separator 170 integrated in the combustion section 114, for separating solid material entrained with the flue gas exiting from the combustion section 114. The separated solids are returned along the return duct 172 to the lower part 146 of the combustion section 114.

The particle separator 170 may optionally be arranged as a separate unit, which is connected to the combustion section 114 by a channel. The circulating fluidized bed boiler 112 in accordance with FIG. 2 is provided with only one particle separator 170, but a large circulating fluidized bed boiler may preferably be provided with at least two particle separators.

Cleaned gas exits the particle separator 170 along the channel 122 to the heat exchange section 116. The channel 122 is preferably connected to the lower part of a side wall 156 of the heat exchange section 116, whereby it has been possible to provide the bottom of the heat exchange section with a hopper 160. The ash accumulating in the hopper 160 may be removed from the heat exchange chamber 116 along an ash discharge channel 162.

While the invention has been herein described by way of examples in connection with what are at present considered to be the preferred embodiments, it is to be understood that the invention is not limited to disclosed embodiments, but is intended to cover various combinations and/or modifications of its features and other applications within the scope of the invention as defined in the appended claims.

CLAIM OF PRIORITY

This application claims priority from Finnish patent application No. 2002-2099, filed Nov. 26, 2002, and PCT patent application number PCT/FI03/00900, filed Nov. 26, 2003, both of which are incorporated by reference herein in their entirety.

The invention claimed is:

1. A boiler plant, comprising a combustion section;

a heat exchange section including heat exchange surfaces, arranged above said combustion section and having a flow direction from the bottom upwards; and a stationary supporting structure, wherein said combustion section and said heat exchange section are separate chambers, flexibly joined with each other, and which chambers are each separately hung from their upper part to the stationary supporting structure.

2. A boiler in accordance with claim 1, wherein the heights of the combustion section and heat exchange section are approximately equal.

3. A boiler in accordance with claim 1, wherein the height of the heat exchange section is approximately 25–60% of the height of the boiler plant.

4. A boiler in accordance with claim 1, wherein the supporting structure comprises a horizontal lower supporting plane, to which the combustion section is hung, and an upper supporting plane, to which the heat exchange section is hung.

5. A boiler in accordance with claim 1, wherein the combustion section and heat exchange section are connected to each other by means of a flexible channel.

6. A boiler in accordance with claim 5, wherein the channel is cooled.

7. A boiler in accordance with claim 5, wherein one of the channel and the bottom of the heat exchange section is provided with a hopper, to which ash that has fallen from the heat exchange surfaces accumulates.

8. A boiler in accordance with claim 1, wherein the boiler is a pulverized coal fired boiler.

9. A boiler in accordance with claim 1, wherein the boiler is a circulating fluidized bed boiler and the channel comprises a particle separator.

* * * * *